United States Patent [19]

Nakayama et al.

[11] 4,226,572

[45] Oct. 7, 1980

[54] VALVE ASSEMBLY FOR A MULTI-CYLINDER SWASH PLATE TYPE COMPRESSOR

[75] Inventors: Shozo Nakayama; Mitsuhiro Hattori; Makoto Ono, all of Kariya, Japan

[73] Assignee: Kabushiki Kaisha Toyoda Jidoshokki Seisakusho, Aichi, Japan

[21] Appl. No.: 6,130

[22] Filed: Jan. 24, 1979

[30] Foreign Application Priority Data

Feb. 10, 1978 [JP] Japan ..... 53-14433

[51] Int. Cl.[3] ..... F04B 1/18

[52] U.S. Cl. ..... 417/269

[58] Field of Search ..... 417/269, 270, 222

[56] References Cited

U.S. PATENT DOCUMENTS 3,215,341 11/1965 Francis ..... 417/269

3,754,842 8/1973 Schlansky ..... 417/269

4,101,250 7/1978 Narayama ..... 417/269

*Primary Examiner*—William L. Freeh

*Attorney, Agent, or Firm*—Burgess, Ryan and Wayne

[57] ABSTRACT

A valve assembly, for a multi-cylinder swash plate type compressor, which includes a gasket means made of a metallic plate and coated, on both faces thereof, with a resilient film, such as a rubber film. The gasket means comprises an outermost, an intermediate, and an innermost annular portion for applying a hermetic seal effect to low and high pressure refrigerant chambers in the compressor. The annular portions of the gasket means are interconnected by a rib means including a plurality of ribs functioning to permit only a predetermined magnitude of opening motion of outlet reed valve means of the compressor.

6 Claims, 4 Drawing Figures

VALVE ASSEMBLY FOR A MULTI-CYLINDER SWASH PLATE TYPE COMPRESSOR

The present invention relates to a valve assembly adapted for being accommodated into a multi-cylinder compressor, especially a multi-cylinder swash-plate type compressor used in an air-conditioning system for vehicles.

A swash-plate type compressor for use in an air-conditioning system of vehicles is disclosed, for example, in Nakayama et al U.S. Pat. No. 3,955,899. In the disclosed swash-plate type compressor, a pair of axially combined cylinder blocks is provided therein with a multi-piston swash plate compressing mechanism, and therefore, each of the combined cylinder blocks is formed with a plurality of cylinder bores in which the pistons provide a reciprocal compression effect for refrigerant fluid. In the typical embodiment of the compressor of U.S. Pat. No. 3,955,899, each cylinder block of the combined cylinder blocks is formed with three cylinder bores, so that the entire compressor has six cylinder bores and three double-acting pistons reciprocating in the six cylinder bores. The combined cylinder blocks of the six cylinder compressor are closed, at the front and rear ends thereof, with a front and a rear end housing having therein a low pressure refrigerant chamber and a high pressure refrigerant chamber, respectively. A valve assembly is positioned between the front and rear ends of the combined cylinder blocks and the front and rear end housings, respectively. On the other hand, the Mitchell U.S. Pat. No. 3,761,202 discloses a multi-cylinder wobble plate type compressor with a single cylinder block. In the typical embodiment of the compressor of U.S. Pat. No. 3,761,202, the single cylinder block is formed with five cylinder bores in which five single-acting pistons reciprocate to compress fluid. One end of the single cylinder block of the five cylinder compressor is closed by a cylinder head having therein a radially outer low pressure fluid chamber and an inner high pressure fluid chamber. Between the end of the single cylinder block and the cylinder head, there is provided a valve assembly including a valve plate, inlet and outlet reed valves, and suitable seals. Based upon the design principles of the above-mentioned known multi-cylinder compressors, it is possible to provide a swash-plate type compressor of the type having a pair of axially combined cylinder blocks formed with a total of ten cylinder bores, five double-acting pistons reciprocating in the ten cylinder bores, and two cylinder heads attached to both ends of the combined cylinder block, without causing any increase in the size of a swash-plate type compressor over that of the known six-cylinder swash-plate type compressor disclosed in U.S. Pat. No. 3,955,899. As a result, the compression performance, i.e., the displacement of the swash-plate type compressor, will be enhanced. With this ten cylinder swash-plate type compressor, however, it is obvious that an increase in the number of parts and elements necessary for constituting valve assemblies which are positioned between both ends of the combined cylinder blocks and the cylinder heads is inevitable. This is because each of the valve assemblies must be provided with five inlet reed valves and five outlet reed valves with their retainers. It is further obvious that such an increase in the number of parts and elements of the valve assemblies will make the assembling process of a swash-plate type compressor very complicated.

Therefore, an object of the present invention is to provide a simplified construction of a valve assembly for a multi-cylinder swash plate type compressor, which enables the uncomplicated assembling of the compressor. Another object of the present invention is to provide a multi-cylinder swash plate type compressor accommodating therein simplified valve assemblies.

The present invention will be more apparent from the ensuing description of a preferred embodiment illustrated in the accompanying drawings wherein.

Figure 1:
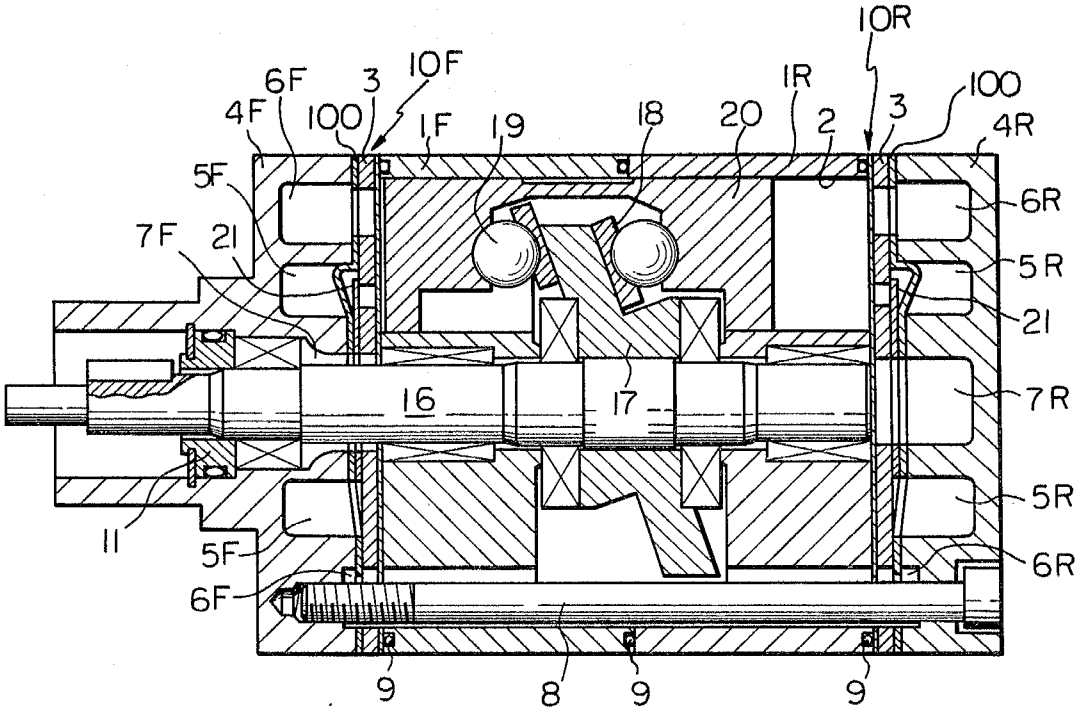
FIG. 1 is a longitudinal cross-sectional view of a multi-cylinder swash-plate type compressor with a pair of axially combined cylinder blocks having a total of ten cylinder bores and with valve assemblies according to an embodiment of the present invention.

Referring to FIG. 1, illustrating an internal arrangement of a swash plate type compressor having five cylinder bores in each of a front and rear cylinder block and employing valve assemblies of the present invention, the compressor has a pair of cylindrical cylinder blocks, i.e., a front cylinder block 1F and a rear cylinder block 1R, combined with each other in an axial alignment, and thereby forming a combined cylinder block. Each of the front and rear cylinder blocks 1F and 1R is formed with five axially extending cylinder bores 2 which are arranged around a central axis of the combined cylinder block at an equal circumferential distance between the neighbouring two cylinder bores 2. The five cylinder bores 2 of the front cylinder block 1F are axially in alignment with those of the rear cylinder block 1R. The front end of the combined cylinder block is closed by a front housing 4F, via a valve assembly 10F, and the rear end of the combined cylinder block is closed by a rear housing 4R, via a valve assembly 10R. The front and rear housings 4F and 4R in the form of a round bell are, respectively, formed with substantially annularly extending high pressure refrigerant chambers 5F and 5R surrounding central oil reserving chambers 7F and 7R. The front and rear housings 4F and 4R are also formed with outermost low pressure refrigerant chambers 6F and 6R extending so as to substantially surrounding the high pressure refrigerant chambers 5F and 5R, respectively. The low pressure refrigerant chambers 6F and 6R are interconnected with the oil reserving chambers 7F and 7R, respectively, by means of appropriate passageways not illustrated in FIG. 1. The high pressure refrigerant chambers 5F and 5R are, respectively, provided with a refrigerant discharge outlet (not illustrated in FIG. 1) for discharging the compressed high pressure refrigerant toward an outside air-conditioning system. The front and rear valve assemblies 10F and 10R have the same structure, and each of the two valve assemblies 10F and 10R includes a valve plate 3 directly attached to the end of either one of the front and rear ends of the combined cylinder block. The valve plate 3 is formed with a central bore interconnectable with the oil reserving chamber 7F or 7R, suction ports for connection of the low pressure refrigerant chamber 6F or 6R and the cylinder bores 2 at the suction stage of respective cylinder bores, discharge ports for connection of the cylinder bores 2 and the high pressure refrigerant chamber 5F or 5R at the discharge stage of respective cylinder bores, and a bore through which a bolt 8, referred to later, passes. The inner side of each suction port of the valve plate 3 is closed by an openable inlet reed valve (not illustrated in FIG. 1). On the other hand, the outer side of each discharge port of the valve plate 3 is closed by an openable outlet reed valve 21. Between the outer face of the valve plate 3 and the front or rear housing 4F or 4R, a gasket means 100 is provided, which also functions as a retaining means for the outlet reed valve 21. The front and rear housings 4F and 4R, the two valve assemblies, and the combined cylinder block are tightly combined together by means of the bolt 8 inserted from the side of the rear housing 4R toward the side of the front housing 4F through the combined cylinder block. Coaxially passing through both cylinder blocks 1F and 1R, front housing 4F, and front valve assembly 10, a drive shaft 16 is rotatably supported by suitable bearing means, and is provided with a swash plate 17 secured thereto. The swash plate 17 is operatively connected with, via ball bearings 19 and shoes 18, double acting multi-pistons 20 which are slidably fitted in the cylinder bores 2 of the combined cylinder block. Reference numeral 9 indicates a ring seal for applying an air-tight seal between the two different mated parts, and reference numeral 11 is a conventional oil seal.

The structure of the gasket means 100 of the valve assembly 10F or 10R will hereinbelow be described with reference to the gasket means provided for the rear valve assembly 10R.

Figure 2:
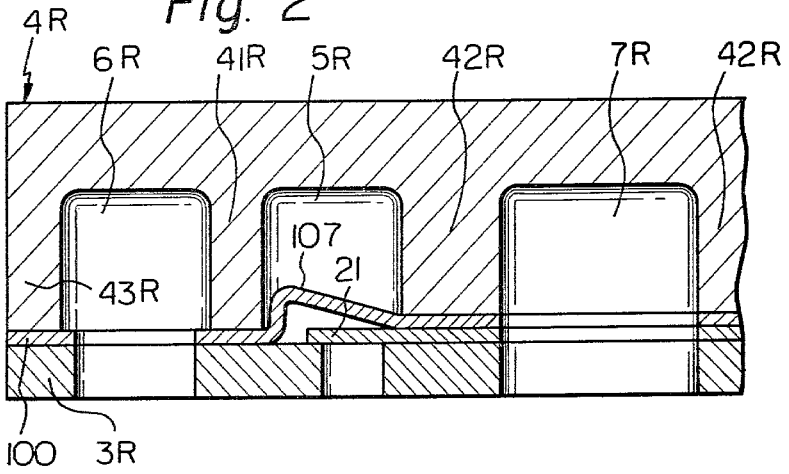
FIG. 2 is an enlarged view of FIG. 1 illustrating an assembled state of the valve assembly.
Figure 3:
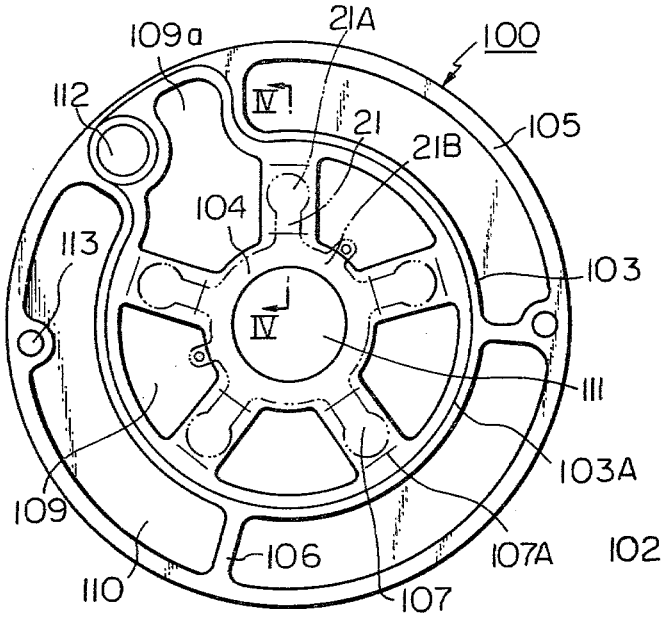
FIG. 3 is a plan view of the gasket means of the valve assembly of FIGS. 1 and 2.
Figure 4:
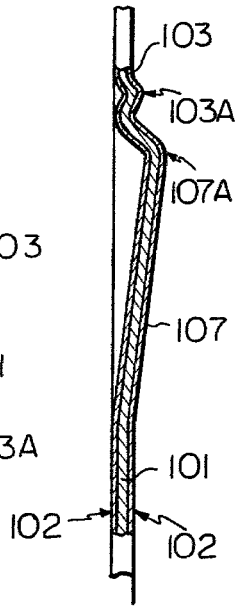
FIG. 4 is a cross-sectional view taken along the line IV—IV of FIG. 3.

Referring to FIGS. 2 through 4, the gasket means 100 is made of a thin steel plate 101 having a generally circular shape, of which the diameter is substantially equal to the valve plate 3 and the rear housing 4R. The thin steel plate 101 is coated, on both sides, with a resilient film, such as a rubber film. The gasket means 100 is centrally formed with a circular aperture 111 in axial alignment with the central oil reserving chamber 7R of the rear housing 4R. Surrounding the central aperture 111, the gasket means is also formed with substantially fan-shaped apertures 109 and 109*a*, which are arranged in coaxial relationship with the high pressure refrigerant chamber 5R of the rear housing 4R. The gasket means 100 is furthermore formed with three circumferentially longitudinal apertures 110, which are arranged in coaxial relationship with the low pressure refrigerant chamber 6R of the rear housing 4R. The gasket means 100 is provided with an intermediate annular portion 103 confronting a separation wall 41R of the rear housing 4R, which wall separates the high pressure refrigerant chamber 5R from the low pressure refrigerant chamber 6R. The gasket means 100 is also provided with an innermost annular portion 104 confronting a separation wall 42R of the rear housing 4R, which wall separates the high pressure refrigerant chamber 5R from the oil reserving chamber 7R. An outermost annular portion 105 of the gasket means 100 is provided so as to be mated with an outermost wall 43R of the rear housing 4R. As will be understood from FIG. 2, these three annular portions 103, 104 and 105 apply hermetic seals to respective boundary portions of the high pressure and low pressure refrigerant chambers 5R and 6R, as well as the boundary portion of the oil reserving chamber 7R. The innermost annular portion 104 of the gasket means 100 also functions to retain in position the outlet reed valve 21 having an annular base portion 21B and five radially extending reeds 21A. The intermediate annular portion 103 of the gasket means 100 is formed with a waved portion 103A as illustrated in FIG. 4. The waved portion 103A of the portion 103 is flexible. Therefore, when the gasket means 100 is assembled and inserted between the outerface of the valve plate 3 and the rear housing 4R, the waved portion 103A is stretched by an axial pressure exerted by the separation wall 41R of the rear housing 4R against the end face of the valve plate 3. Due to the fact that the flexible waved portion 103A is stretched to be flattened, the hermetic seal effect provided by the portion 103 of the gasket means 100 is highly enhanced. The above-mentioned three annular portions 103, 104 and 105 are interconnected with one another by means of a plurality of radial ribs 106 and 107, so that one integral gasket means 100 is constituted. The radial ribs 107 are arranged so as to be in alignment with five reeds 21A of the outlet reed valve 21.

As is best shown in FIG. 4, each of the radial ribs 107 extending between the innermost annular portion 104 and the intermediate annular portion 103 of the gasket means 100 is outwardly bent so as to radially slope up from the side of the annular portion 104 toward the side of the annular portion 103 when viewed from the outerface side of the gasket means 100. A peak portion 107A is formed in the portion close to the waved portion 103A of the intermediate annular portion 103. The outwardly bent ribs 107 having the peak portion 107A, respectively, operate so as to permit a predetermined magnitude of opening motion of each reed 21A of the outlet reed valve 21. A hole 112 in the gasket means 100 is provided for passing the bolt 8 therethrough. Holes 113 are provided for achieving a correct positioning of the gasket means 100 with respect to the valve plate 3 and the rear housing 4R.

As will be understood from the foregoing, the gasket means of the valve assembly according to the present invention, is provided with three outermost, intermediate and innermost annular portions for applying hermetic seals to the boundary portions of the low pressure refrigerant chamber, the high pressure refrigerant chamber and the oil reserving chamber, respectively. Furthermore, the above-mentioned three annular portions are mutually connected by means of a plurality of radial ribs so that one integral gasket means is presented. Some of the plurality of ribs are arranged so as to be in alignment with the reeds of the outlet reed valve, and are provided with outwardly bent portions which operate so as to permit only a predetermined magnitude of opening motion of the reeds of the outlet reed valve. The gasket means together with the outlet reed valve is positioned between a valve plate and either one of the front and rear housings. Therefore, the gasket means functions so as to retain the outlet reed in position. As a result, the outlet reed valve can be assembled into a multi-cylinder swash plate type compressor without any particular mounting means, such as a screw bolt. Further no valve motion stopper is required. Consequently, the assembling of a multi-cylinder swash plate type compressor can be very simple.

Furthermore, since the gasket means is made of a steel plate coated with a rubber film on both sides thereof, noise is absorbed very well, even if the outlet reeds of the outlet reed valve strike against the gasket means during the opening motion of the outlet valve means. The employment of the steel plate is very effective for strengthening the gasket means per se. During the assembling of a multi-cylinder swash plate type compressor employing the valve assembly of the present invention, the front and rear cylinder blocks, the front and rear valve assemblies, and the front and rear housings are combined together by a strong axial pressure. Therefore, it is not necessary that the inner faces of the front and rear housings be accurately flat. Consequently, no precise machining of the front and rear housings is required. As a result, the manufacturing cost of the front and rear housings, and eventually the manufacturing cost of a multi-cylinder swash plate type compressor, can be reduced compared with that of the conventional swash plate type compressor.

While the present invention has been described with reference to its preferred embodiment, it is to be understood that modifications will occur to those skilled in the art without departing from the spirit of the invention. For example, if preferred, the gasket means of the valve assembly of the present invention can be made of a strong aluminum alloy coated with a resilient film, so that the weight of the valve assembly become lighter.

What is claimed is:

1. A valve assembly for a multi-cylinder compressor of the type having: a pair of axially combined cylindrical cylinder blocks provided therein with a plurality of axial cylinder bores together with a double acting reciprocal compression mechanism, and; a front and a rear round end housing attached to a front and a rear end of the combined cylinder blocks, via a valve assembly, respectively, each of the front and rear housings having therein a low pressure refrigerant chamber, a high pressure refrigerant chamber, and an oil retaining chamber separated from one another by walls provided inside of each of the front and rear housings, comprising:

a valve plate having suction ports for connecting said low pressure refrigerant chamber of either one of said front and rear housings and said cylinder bores of said combined cylinder blocks, and discharge ports for connecting said high pressure refrigerant chamber of either one of said front and rear housings and said cylinder bores:

an intake reed valve means which is provided and is positioned between either one of said front or rear ends of said combined cylinder blocks and an inner face of said valve plate, said intake reed valve means being operable for openably closing said suction ports of said valve plate;

a discharge reed valve means disposed adjacent to an outer face of said valve plate, said discharge reed valve means being operable for openably closing said discharge ports of said valve plate, and;

an integral gasket means made of a metallic plate having an inner and an outer face coated respectively with a resilient film, said gasket means being adapted to be arranged between said outer face of said valve plate and either one of said front or rear housings, and comprising an outermost, an intermediate and an innermost annular portion for applying hermetic seals to boundary portions of said low and high pressure refrigerant chambers and said oil retaining chamber of either one of said front or rear housings, and a rib means interconnected between said outermost and said intermediate annular portions, and between said intermediate and said innermost annular portions, said rib means including radially extending ribs which are arranged in alignment with said discharge valve means and have, respectively, a portion bent outwardly with respect to said outer face of said valve plate for permitting a predetermined magnitude of opening motion of said discharge valve means.

2. A valve assembly according to claim 1, wherein one of said outermost, intermediate and innermost annular portions of said gasket means is arranged for retaining said discharge valve means between said gasket means and said valve plate.

3. A valve assembly according to claim 1, wherein one of said outermost, intermediate and innermost annular portions of said gasket means is formed with a stretchable waved portion effective for applying said hermetic seals to said boundary portions of said high pressure refrigerant chamber of either one of said front or rear housings.

4. A valve assembly according to claim 1, wherein said metallic plate of said gasket means is a circular steel plate.

5. A swash plate type compressor comprising:

a pair of axially combined cylindrical cylinder blocks, one of said cylinder blocks having therein five cylinder bores arranged in an axial alignment with those of the other of said cylinder blocks;

five double acting pistons slidably fitted in said cylinder bores of said cylindrical cylinder blocks;

a drive shaft centrally and rotatably supported in said axially combined cylindrical cylinder blocks;

a swash plate secured to said drive shaft and operatively connected to said five double acting pistons, via ball bearings and shoes, and;

a front and a rear round end housing attached to a front and a rear end of the combined cylinder blocks, via a valve assembly, respectively, each of said front and rear end housings having therein a central oil retaining chamber, an intermediate high pressure refrigerant chamber surrounding said central oil retaining chamber, and an outermost low pressure refrigerant chamber surrounding said high pressure refrigerant chamber, said chambers being separated from one another by walls provided inside of each of the front and rear housings, said valve assembly comprising a valve plate having five suction ports connecting said low pressure refrigerant chamber of either one of said front or rear housings and said five cylinder bores of said combined cylinder blocks, and five discharge ports connecting said high pressure refrigerant chamber of either one of said front or rear housings and said five cylinder bores of said combined cylinder blocks, an intake reed valve means positioned between either one of said front or rear ends of said combined cylinder blocks and an inner face of said valve plate, said intake reed valve means operating so as to openably close said five suction bores of said valve plate, a discharge reed valve means disposed adjacent to an outer face of said valve plate, said discharge reed valve means having five reeds operating so as to openably close said five discharge ports of said valve plate, an integral gasket means made of a metallic plate having an inner and outer face coated respectively with a resilient film, said gasket means being arranged between said outer face of said valve plate and either one of said front or rear housings, and comprising an outermost, an intermediate and an innermost annular portion arranged for applying hermetic seals to boundary portions of said outermost low and intermediate high pressure refrigerant chambers and said central oil retaining chamber of either one of said front or rear housings, and a rib means interconnected between said outermost and said intermediate annular portions, and between said intermediate and said innermost annular portions, said rib means including five radially extending ribs which are arranged in alignment with said five reeds of said discharge valve means and have, respectively, a portion bent outwardly with respect to said outer face of said valve plate for permitting a predetermined magnitude of opening motion of said reeds of said discharge valve means.

6. A swash plate type compressor according to claim 5, wherein said discharge valve means include an annular portion from which said reeds radially extend, and wherein said innermost annular portion of said gasket means retains said annular portion of said discharge valve means.

* * * * *